US009644283B2

(12) United States Patent
Hankey et al.

(10) Patent No.: US 9,644,283 B2
(45) Date of Patent: May 9, 2017

(54) LASER TEXTURIZING AND ANODIZATION SURFACE TREATMENT

(75) Inventors: Evans Hankey, San Francisco, CA (US); Michael S. Nashner, San Jose, CA (US); Peter Russell-Clarke, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 57 days.

(21) Appl. No.: 13/250,588

(22) Filed: Sep. 30, 2011

(65) Prior Publication Data

US 2013/0081951 A1 Apr. 4, 2013

(51) Int. Cl.

| | |
|---|---|
| ***C25D 5/34*** | (2006.01) |
| ***C25D 11/04*** | (2006.01) |
| ***C25D 11/16*** | (2006.01) |
| ***C25D 11/26*** | (2006.01) |
| ***C25D 11/30*** | (2006.01) |

(52) U.S. Cl.
CPC ..... *C25D 11/16* (2013.01); *C25D 11/26* (2013.01); *C25D 11/30* (2013.01)

(58) Field of Classification Search
CPC ..... C25D 5/34; C25D 11/02; C25D 11/34
USPC ..... 205/118, 120, 121, 205, 209, 210, 213, 205/214, 316, 324, 206, 208, 333
See application file for complete search history.

(56) References Cited

U.S. PATENT DOCUMENTS 2,703,781 A * 3/1955 Hesch ..... 205/213
5,062,021 A 10/1991 Ranjan et al.
5,166,093 A 11/1992 Grief
6,143,375 A 11/2000 Ross et al.
6,433,303 B1 * 8/2002 Liu ..... B23K 26/067 219/121.7
7,387,740 B2 * 6/2008 Lai ..... B44C 1/227 204/485
7,452,473 B1 * 11/2008 Hemphill ..... C23F 1/02 205/640
2001/0030002 A1 * 10/2001 Zheng ..... C23C 8/10 148/241
2002/0153423 A1 * 10/2002 Schramm ..... 235/487
2003/0014895 A1 * 1/2003 Lizotte ..... 42/1.01
(Continued)

FOREIGN PATENT DOCUMENTS

CN 2546462 4/2003
CN 1654714 A * 8/2005 ..... C25D 11/16
(Continued)

OTHER PUBLICATIONS

Bonelli, "Morphological Changes Induced on Aluminum Surfaces by Excimer Laser Irradiation", Applied Surface Science (no month, 2002), vol. 186, pp. 211-215.*
(Continued)

*Primary Examiner* — Edna Wong
(74) *Attorney, Agent, or Firm* — Downey Brand, LLP

(57) ABSTRACT

A method of treating a metallic surface of an article including the steps of providing an article having a metallic surface; texturizing the surface using a laser to create a controlled pattern across the surface; and anodizing the surface. The controlled pattern may include a series of pits etched in a predetermined repeating pattern across the surface, such as an array of dots or a grid. The controlled pattern may also include a series of pits etched in a predetermined pseudo-random pattern across the surface.

20 Claims, 13 Drawing Sheets

(56) References Cited

U.S. PATENT DOCUMENTS

| | | | | |
|---|---|---|---|---|
| 2003/0194572 | A1 | 10/2003 | Cooper et al. | |
| 2004/0065346 | A1 | 4/2004 | Wei et al. | |
| 2004/0118813 | A1 | 6/2004 | Lai | |
| 2006/0049141 | A1 | 3/2006 | Lai | |
| 2006/0130936 | A1* | 6/2006 | Mawston | C23F 3/02 148/241 |
| 2008/0156057 | A1* | 7/2008 | Lin et al. | 72/112 |
| 2008/0216926 | A1* | 9/2008 | Guo | B23K 26/0084 148/565 |
| 2010/0051467 | A1 | 3/2010 | Tian et al. | |
| 2010/0112297 | A1 | 5/2010 | Dai et al. | |
| 2010/0183869 | A1 | 7/2010 | Lin et al. | |
| 2010/0219506 | A1 | 9/2010 | Gupta et al. | |
| 2011/0017602 | A1 | 1/2011 | Khosla | |
| 2011/0020665 | A1* | 1/2011 | Serafin | C22C 21/00 428/629 |
| 2011/0056836 | A1 | 3/2011 | Tatebe et al. | |

FOREIGN PATENT DOCUMENTS

| | | | | |
|---|---|---|---|---|
| CN | 101210336 | | 7/2008 | |
| CN | 101730415 | | 6/2010 | |
| JP | S6220898 | | 1/1987 | |
| JP | 01100298 | A * | 4/1989 | C25D 11/04 |
| JP | H06256993 | | 9/1994 | |
| JP | 2003513828 | | 4/2003 | |
| JP | 2008012567 | A * | 1/2008 | B23K 26/00 |
| JP | 2010125466 | A * | 6/2010 | B23K 26/38 |
| WO | WO 99/09549 | | 2/1999 | |
| WO | WO0134408 | | 5/2001 | |

OTHER PUBLICATIONS

Bonelli et al., "Morphological Changes Induced on Aluminum Surfaces by Excimer Laser Irradiation", Applied Surface Science (no month, 2002), vol. 186, pp. 211-215.*

McCafferty et al., "Effect of Laser-Surface Melting on the Electrochemical Behavior of an Al-1% Mn Alloy", J. Electrochem. Soc.: Electrochemical Science and Technology (Jan. 1982), vol. 129, No. 1, pp. 9-17.*

Gu, "Review—40 Years of Laser Marking—Industrial Applications", In Lasers and Applications in Science and Engineering International Society for Optics and Photonics (no month, 2006), pp. 610601-1 (pp. 1-7).*

Nakata et al., "Fabrication of Dot Matrix, Comb, and Nanowire Structures Using Laser Ablation by Interfered Femtosecond Laser Beams", Applied Physics Letters (Nov. 25, 2002), vol. 81, No. 22, pp. 4239-4241.*

Kanehira et al., "Periodic Nanovoid Structures via Femtosecond Laser Irradiation", Nano Letters (no month, 2005), vol. 5, No. 8, pp. 1591-1595.*

Vilhena et al., "Surface Texturing by Pulsed Nd:YAG Laser", Tribology International (no month, 2009), vol. 42, pp. 1496-1504.*

Jha et al., "Microfabrication of an Anodic Oxide Film by Anodizing Laser-Textured Aluminum," J. Micromech. Microeng. (no month, 2007), vol. 17, pp. 1949-1955.*

Prater et al., "Selecting a Contamination-Free Deburring Process: Testing Abrasive Blasting Media," Particles on Surfaces: Detection: Adhesion, and Removal (no month, 1994), pp. 151-152, 154 and 159.*

Jha et al., "Microfabrication of an Anodic Oxide Film by Anodizing Laser-Textured Aluminium," J. Micromech. Microeng. (no month, 2007), vol. 17, pp. 1949-1955.*

Prater et al., "Selecting a Contamination-Free Deburring Process: Testing Abrasive Blasting Media," Particles on Surfaces: Detection: Adhesion, and Removal (no month, 1994), pp. 151-152, 154 and 159).*

PCT/US2012/057150—ISR and Written Opinion mailed Mar. 20, 2013.

ETCHamac, "Custom Laser Etching," (http://www.etchamac.com/), retrieved Dec. 20, 2011, 1 page.

Metal Improvement Company, Curtiss-Wright Corporation, "Laser Peening Component Protection," retrieved Jul. 26, 2011, 4 pages.

Viejo, F., et al., "Enhanced performance of the AA2050-T8 aluminium alloy following excimer laser surface melting and anodising processes," *Thin Solid Films* 518:2722-2731, Elsevier, Amsterdam (Mar. 2010), 10 pages.

Chinese Patent Application No. 201280046345.X—First Office Action dated Jul. 20, 2015.

European Patent Application No. 12837086.3—Supplementary Partial European Search Report dated Jun. 5, 2015.

Japanese Patent Application No. 2014-532097—Office Action dated Jan. 12, 2016.

"Modern Manufacturing Technology", Edition 1, Wang Xiyang, National Defense Industry Press, pp. 146, Apr. 2010.

Chinese Application for Invention No. 201280046345.X—Second Office Action dated Mar. 16, 2016.

Chinese Patent Application No. 201280046345.X—Third Office Action dated Aug. 29, 2016.

* cited by examiner

LASER TEXTURIZING AND ANODIZATION SURFACE TREATMENT

BACKGROUND

Field

The present invention relates to treatments for a surface of an article and an article with such a treated surface. More particularly, the present invention relates to method of performing a laser texturizing and anodization treatment on a metallic surface of an article and such a metallic surface treated according to this method.

Background

Many products in the commercial and consumer industries are metal articles, or contain metal surfaces. Metal surfaces are often treated by any number of processes to create one or more desired functional, tactile, cosmetic, or other effects. In one such process, a surface may be texturized to roughen the surface, shape the surface, remove surface contaminants, or other effects. This texturizing process may be accomplished via one or more mechanical processes such as by machining, brushing, or abrasive blasting. Abrasive blasting, for example, involves forcibly propelling a stream of abrasive material, such as beads, sand, and/or glass, against a surface. Alternatively, a surface may be texturized through a chemical process, such as chemical etching. This process often involves the use of an etching solution, such as a sodium hydroxide (NaOH) solution.

BRIEF SUMMARY

In one embodiment, a method includes the steps of providing an article having a metallic surface, texturizing the surface using a laser to create a controlled pattern across the surface, anodizing the surface. The texturizing step may be performed by moving the laser relative to the surface along a predetermined path and pulsing the laser at an interval to create a series of pits. In one embodiment, the controlled pattern includes the series of pits etched in a predetermined repeating pattern across the surface. This repeating pattern may be in the form of a two-dimensional array of substantially uniformly spaced pits. In another embodiment, the repeating pattern may be in the form of a two-dimensional grid including a series of substantially perpendicular lines created by overlapping pits.

Alternatively, the controlled pattern may include a series of pits etched in a predetermined pseudo-random pattern across the surface. This pseudo-random pattern may approximate the appearance of bead or sand blasting while providing greater control of the pattern and area of blasting.

Additional features of the invention will be set forth in the description that follows, and in part will be apparent from the description, or may be learned by practice of the invention. Both the foregoing general description and the following detailed description are exemplary and explanatory and are intended to provide further explanation of the invention as claimed.

BRIEF DESCRIPTION OF THE FIGURES

The accompanying figures, which are incorporated herein, form part of the specification and illustrate exemplary embodiments of the present invention. Together with the description, the figures further serve to explain the principles of, and to enable a person skilled in the relevant art(s) to make and use the exemplary embodiments described herein.

DETAILED DESCRIPTION

The following detailed description refers to the accompanying figures, which illustrate exemplary embodiments. Other embodiments are possible. Modifications may be made to the exemplary embodiments described herein without departing from the spirit and scope of the present invention. Therefore, the following detailed description is not meant to be limiting. The operation and behavior of the embodiments presented are described with the understanding that modifications and variations may be within the scope of the present invention.

Figure 1:
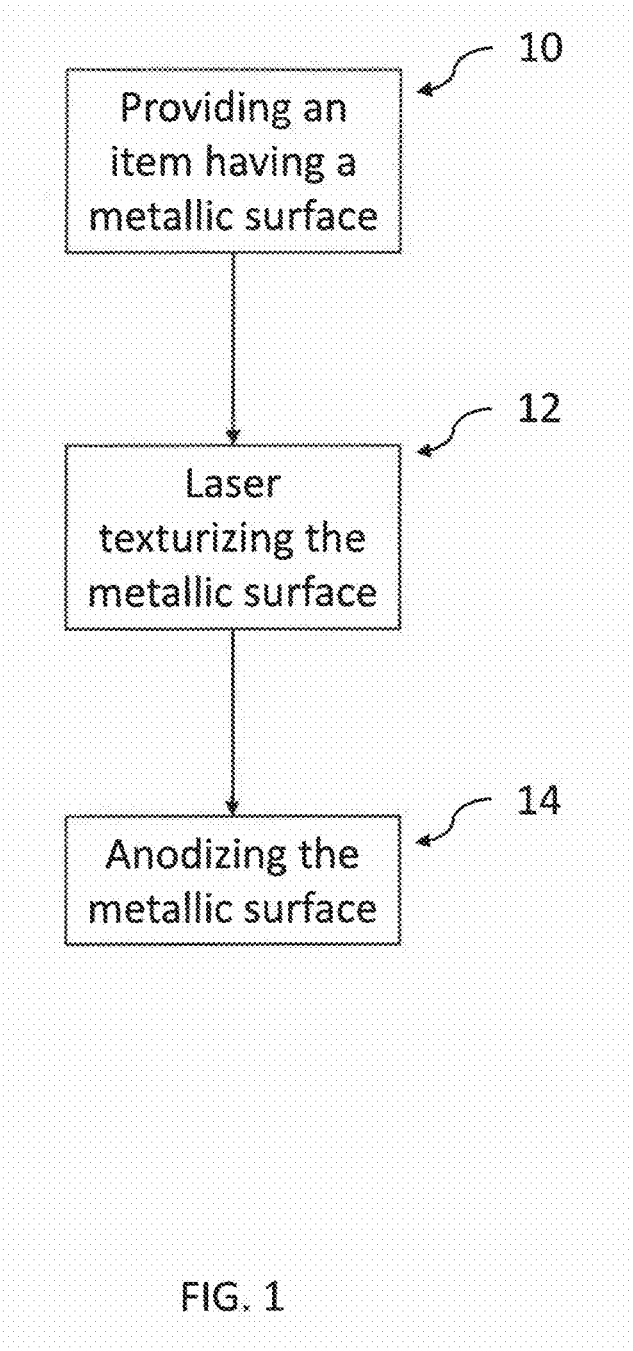
FIG. 1 is a flowchart of an exemplary method of surface treatment, in accordance with one embodiment of the present invention.

FIG. 1 is a high level flowchart of an exemplary method of surface treatment. The method may include a step 10 of providing a metal part having a surface. This method may be applied to a broad range of metal parts including, but not limited to, household appliances and cookware, such as pots and pans; automotive parts; athletic equipment, such as bikes; and electronic components, such as laptop computers and enclosures for electronic devices, such as media players, phones, and computers. In some embodiments, the method may be implemented on a media player or laptop computer manufactured by Apple Inc. of Cupertino, Calif.

Suitable metals include aluminum, titanium, magnesium, niobium and the like. The metal part may be formed using a variety of techniques, and may come in a variety of shapes, forms and materials. Examples of techniques include providing the metal part as a preformed sheet or extruding the metal part so that it is formed in a desired shape. In one example, the metal part may be extruded so that the metal part is formed in a desired shape. Extrusion may be a process for producing a desired shape in a continuous manner of indeterminate length so that the material may be subsequently cut to a desired length. In one embodiment, the metal part may be shape cast via any suitable casting process, such as die casting and permanent mold casting processes, among others. In one embodiment, the metal part may be formed from aluminum, such as extruded 6063 grade aluminum. In some embodiments, the metal part is made of an aluminum-nickel or aluminum-nickel-manganese casting alloy.

The method further includes a step 12 of performing a laser texturizing treatment on the surface of the metal part to create a controlled pattern across the surface. This step may result in one or more decorative, structural, functional, or other effects on the metallic surface. For example, the texturizing step may produce a desired tactile effect, reduce the appearance of minor surface defects, and/or reduce the appearance of fingerprints or smudges. In addition, the texturizing step may be used to create a series of small peaks and valleys. These peaks and valleys may impart a sparkling effect to the surface, which may in some instances make the surface appear brighter.

In one embodiment, step 12 is performed by moving a laser relative to the metallic surface along a predetermined path and pulsing the laser at an interval to create a series of pits. The interval may be a predetermined or not predetermined and may be periodic or non-periodic. The laser may be pulsed several times before moving its location. In addition, the laser may pass along the path several times. In one embodiment, the laser makes four passes along the path. In some embodiments, the laser may be moved relative to a stationary metallic surface, whereas in other embodiments, the metallic surface may be moved relative to a stationary laser.

In some embodiments, the laser is passed over the metallic surface but does not create pits in the surface. For example, the laser may be in the form of a steady beam rather than pulsed as described above. In some embodiments, the laser system is configured to reduce the effects of the laser such that the laser does not create pits in the metal surface. For example, the distance between the laser and the surface can be increased or the power of the laser can be decreased. In one embodiment, the laser merely melts a portion of the surface so that the surface has a different reflectivity than the remainder of the surface. The laser can additionally or alternatively be used to change the grain structure of the surface so that the anodization process is different in the laser-treated area.

One suitable laser for use with this method is the DP2UV laser marking system manufactured by FOBA Technology+ Services GmbH of Lüdenscheid, Germany. This system includes a Neodymium Doped Yttrium Orthvanadate (Nd: $YVO_4$) diode pumped laser having a wavelength of 355 nm, an output power of 2 W, a pulse energy of 0.04 mJ, and a marking speed of up to 5000 mm/s. Other suitable lasers include a 20 W Infrared fiber laser, an 18 W infrared fiber laser, a 50 W infrared YAG laser, a 20 W infrared vanadate laser, and an 18 W picosecond IR laser. The laser system may be electronically controlled via a computer numerical control machine along 3 or more axes as desired. In other embodiments, the laser is moved manually by a user. The laser system may include one or more galvanometers, such as a high speed mirror galvanometer, to control the position of the laser beam. In some embodiments, the laser is pointed perpendicular to the metallic surface, but may alternatively be pointed at an angle to the metallic surface if desired.

The pits created by the laser may be substantially circular in shape, with a diameter of approximately 20-25 μm. The pits may be any other suitable shape, such as triangular, square, oval, or a non-geometric shape, such as a shark-tooth shape. The diameter and depth of the pits may be larger or smaller as desired and may depend on the characteristics of the laser system, such as the laser host, its pulse energy, duration, and number of passes over the surface. The size of the pits may also be affected by the characteristics of the metallic surface. In some embodiments, the surface may have some pits having a first diameter and depth, and some pits having a second, different, diameter and depth. This may be accomplished by changing the laser type or settings, or by making multiple passes over only a portion of the surface.

As described further below with respect to FIGS. 2-11, the controlled pattern may include a series of pits etched in a predetermined repeating or pseudo-random pattern across the surface. In some embodiments, the controlled pattern includes a repeating portion and a non-repeating portion. In some embodiments, the controlled pattern may cover only a portion of the metallic surface.

The method of FIG. 1 further includes a step 14 of performing an anodization process on the metallic surface. Anodizing a metal surface converts a portion of the metal surface into a metal oxide, thereby creating a metal oxide layer. Anodized metal surfaces provide increased corrosion resistance and wear resistance. Anodized metal surfaces may also be used to obtain a cosmetic effect, such as facilitating the absorption of dyes to impart a color to the anodized metal surface.

A standard anodization process may include placing the metal surface in an electrolytic bath having a temperature in a range between about 18 and 22 degrees Celsius. Hard anodization may be accomplished by placing the metal surface in an electrolytic bath having a temperature in a range between about 0 and 5 degrees Celsius.

In one embodiment, anodizing step 14 may create a transparent effect to the metal surface. In this embodiment, the metal surface may be placed in an electrolytic bath that has been optimized to increase the transparent effect of the oxide layer. The electrolytic bath may include sulfuric acid ($H_2SO_4$) in a concentration having a range between about 150 and 210 g/l, about 160 and 200 g/l, or about 170 and 190 g/l, or may be about 180 g/l. The electrolytic bath may also include metal ions that are the same as the metal surface. For, example, the electrolytic bath may include aluminum ions, in a concentration of about less than 15 g/l or in a range between about 4 and 10 g/l, about 5 and 9 g/l, or about 6 and 8 g/l, or may be about 7 g/l. Anodization may occur at a current density in a range between about 1.0 and 1.2 amperes per square decimeter. Anodization may have a duration in a range between about 30 and 60 minutes, about 35 and 55 minutes, or about 40 and 50 minutes, or may be about 45 minutes. The thickness of the oxide layer may be controlled in part by the duration of the anodization process.

Figure 2:
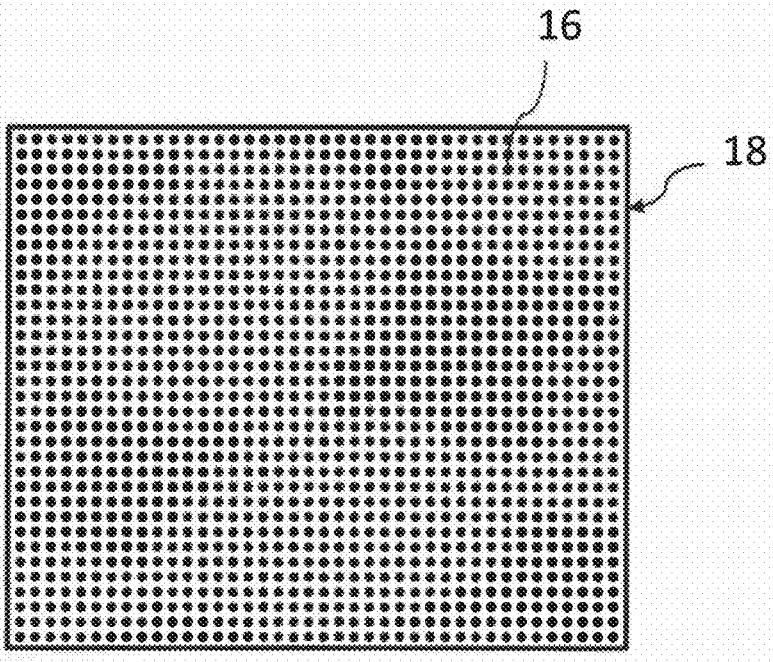
FIG. 2 is an enlarged view of a portion of a surface after an exemplary laser texturizing step, in accordance with one embodiment of the present invention.
Figure 3:
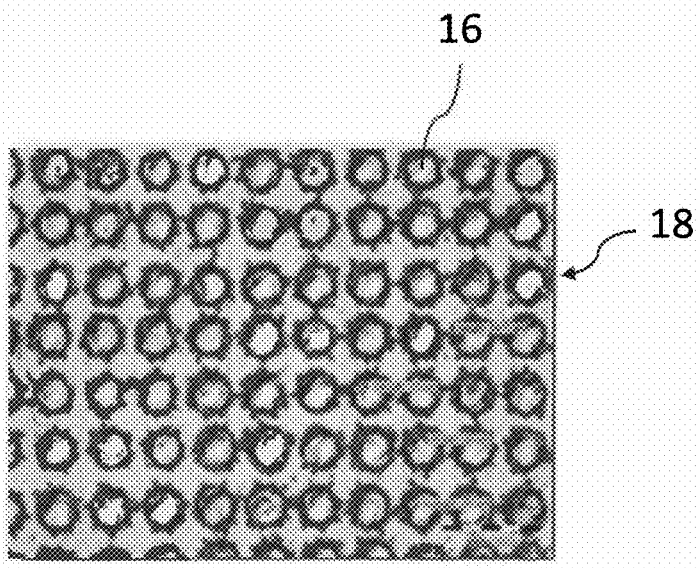
FIG. 3 is an enlarged view of an image showing a portion of a surface after an exemplary laser texturizing step, in accordance with one embodiment of the present invention.
Figure 4:
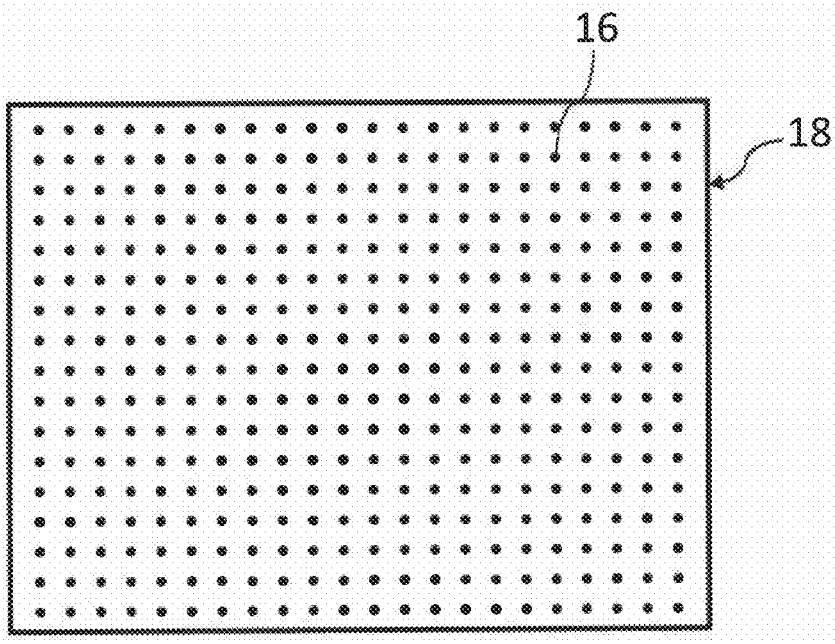
FIG. 4 is an enlarged view of a portion of a surface after an exemplary laser texturizing step, in accordance with one embodiment of the present invention.
Figure 5:
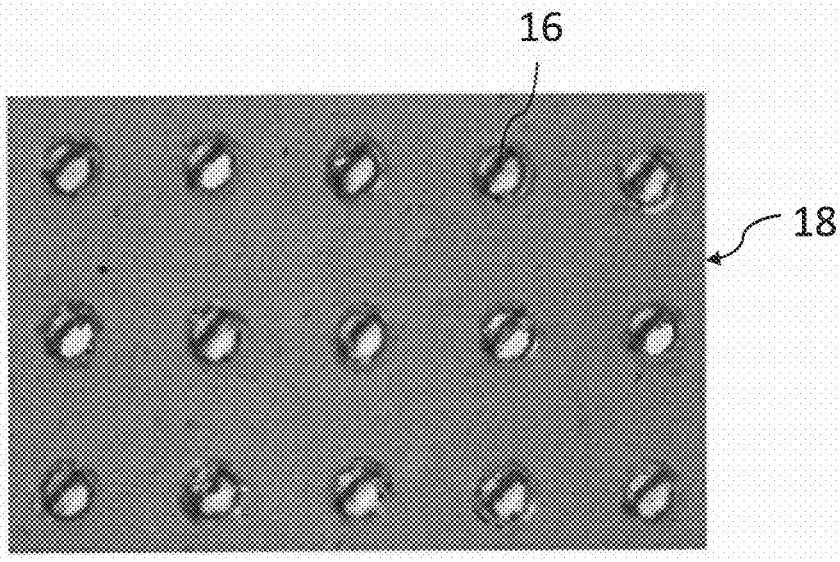
FIG. 5 is an enlarged view of an image showing a portion of a surface after an exemplary laser texturizing step, in accordance with one embodiment of the present invention.
Figure 6:
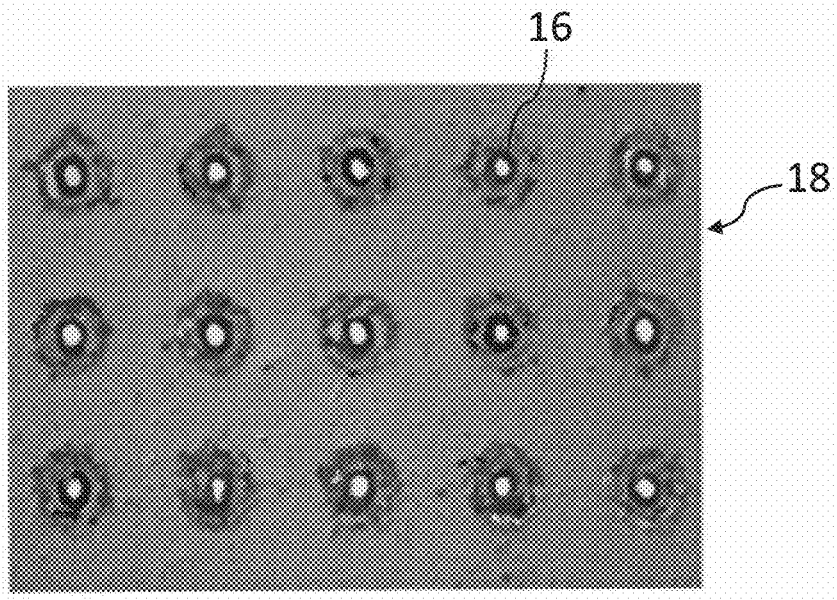
FIG. 6 is an enlarged view of an image showing a portion of a surface after an exemplary laser texturizing step, in accordance with one embodiment of the present invention.

FIG. 2 is an enlarged view of a portion of a surface 18 after exemplary texturizing step 12. This texturizing step 12 may include using a laser to create a controlled pattern including a series of pits 16 etched in a predetermined repeating pattern across surface 18. In this embodiment, the predetermined repeating pattern is in the form of a two-dimensional array of substantially uniformly spaced pits 16 spaced approximately 50 μm apart. FIG. 3 shows an enlarged view of an image showing a portion of surface 18 including pits 16 in a controlled pattern similar to the pattern described above with respect to FIG. 2. FIG. 4 shows an enlarged view of a portion of surface 18 with a controlled pattern having greater spacing between pits 16 when compared to the pattern of FIGS. 2 and 3. FIGS. 5 and 6 each show an enlarged view of an image showing a portion of surface 18 including pits 16 in a controlled pattern similar to the pattern described above with respect to FIG. 4. FIG. 5 shows surface 18 after a single pass of a laser and FIG. 6 shows surface 18 after four passes of a laser.

Figure 7:
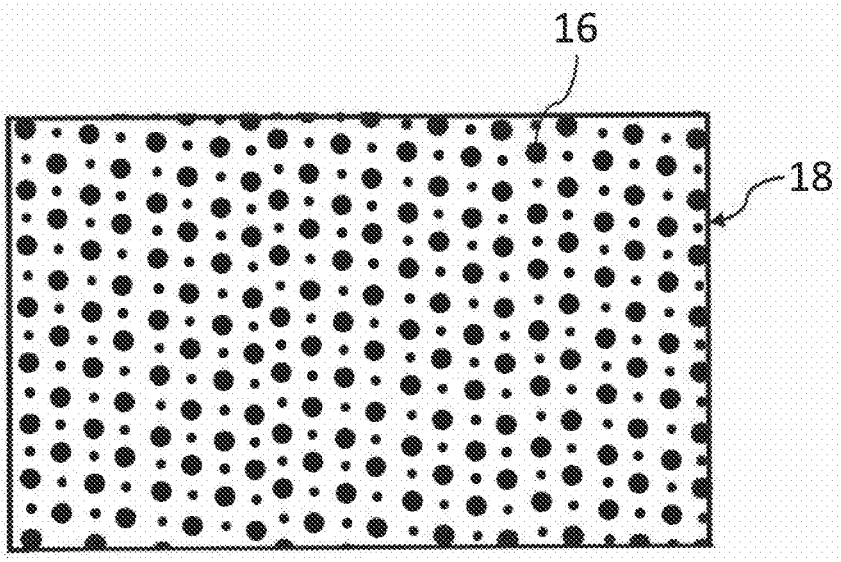
FIG. 7 is an enlarged view of a portion of a surface after an exemplary laser texturizing step, in accordance with one embodiment of the present invention.
Figure 8:
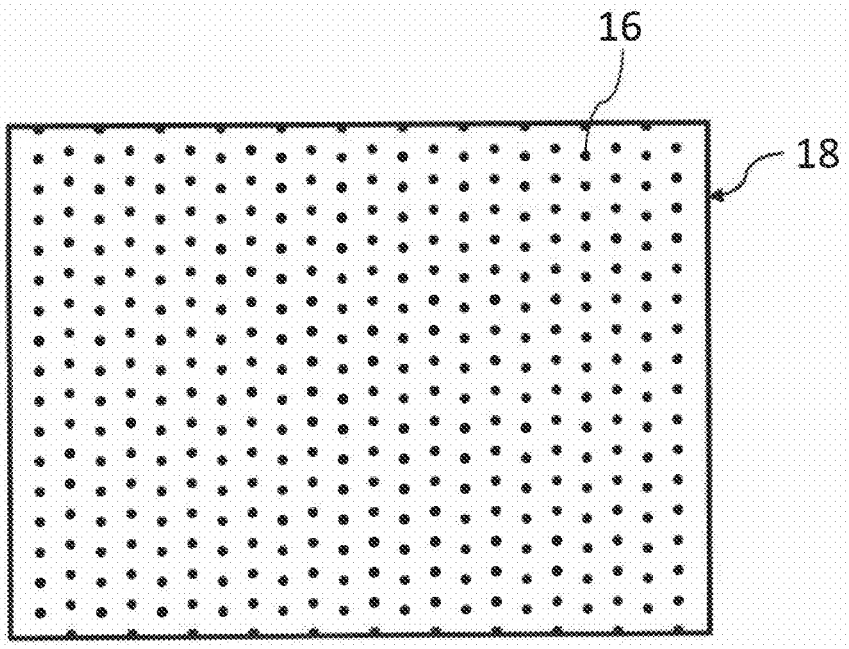
FIG. 8 is an enlarged view of a portion of a surface after an exemplary laser texturizing step, in accordance with one embodiment of the present invention.

FIG. 7 shows an enlarged view of a portion of surface 18 with a pattern including pits 16 of varying sizes formed in columns offset from one another. In some embodiments, the pit depths are varied within the pattern. FIG. 8 shows an enlarged view of a portion of surface 18 with a repeating pattern including pits 16 formed in columns offset from one another.

Figure 9:
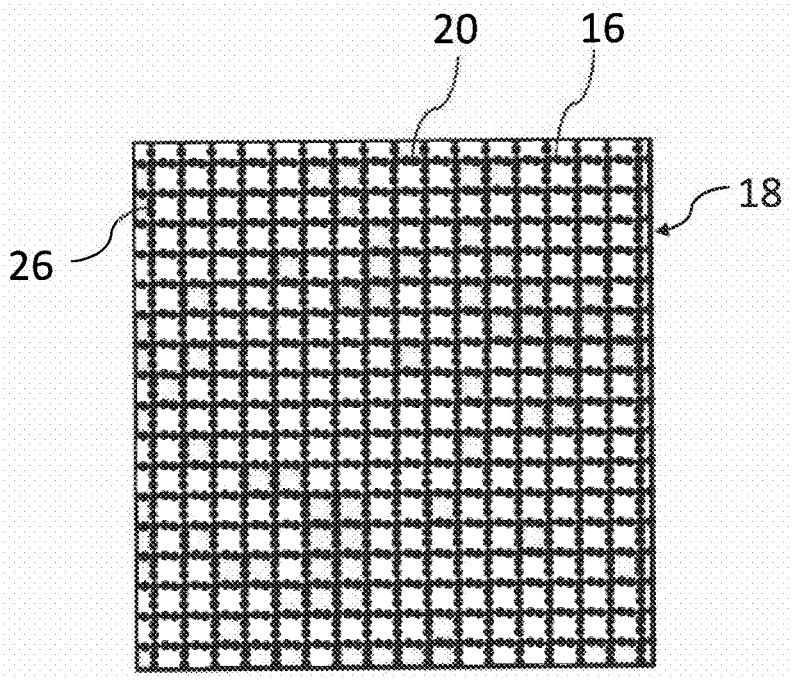
FIG. 9 is an enlarged view of a portion of a surface after an exemplary laser texturizing step, in accordance with one embodiment of the present invention.
Figure 10:
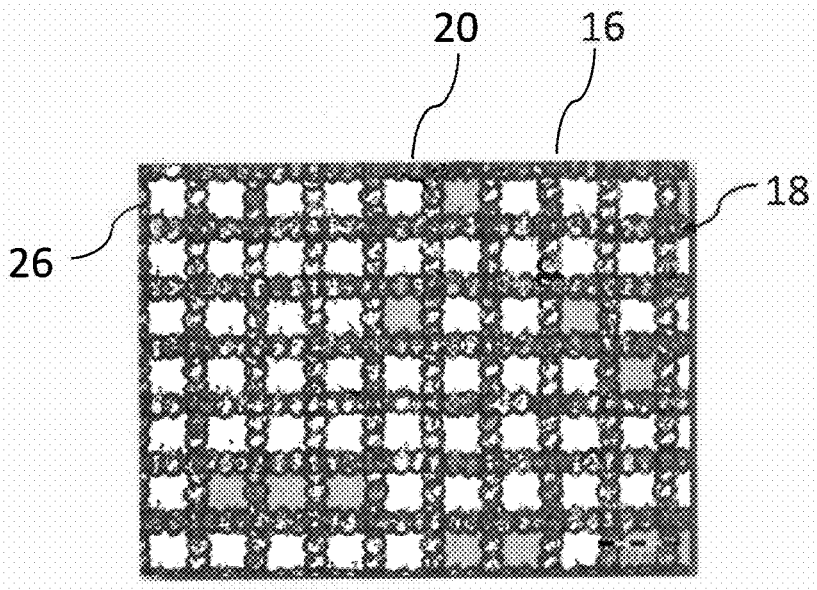
FIG. 10 is an enlarged view of an image showing a portion of a surface after an exemplary laser texturizing step, in accordance with one embodiment of the present invention.

FIG. 9 is an enlarged view of a portion of surface 18 after an exemplary texturizing step 12. This texturizing step 12 may include having a controlled pattern including a series of substantially perpendicular horizontal lines 20 and vertical lines 26 created by overlapping pits 16. In one embodiment, horizontal lines 20 and vertical lines 26 are uniformly spaced approximately 100 μm apart. FIG. 10 shows an enlarged view of an image showing a portion of surface 18 including pits 16 in a controlled pattern similar to the pattern described above with respect to FIG. 9.

Figure 11:
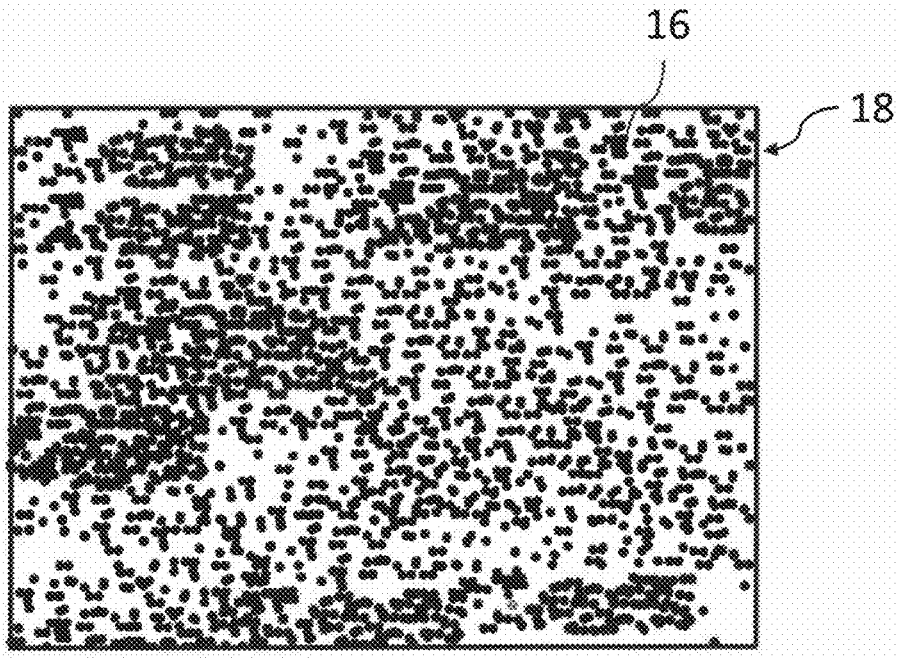
FIG. 11 is an enlarged view of a portion of a surface after an exemplary laser texturizing step, in accordance with one embodiment of the present invention.

FIG. 11 is an enlarged view of a portion of surface 18 after an exemplary texturizing step. This texturizing step 12 may include having a controlled pattern including a series of pits 16 etched in a predetermined pseudo-random pattern across surface 18. As shown in FIG. 11, many of the pits overlap, but in alternative embodiments, the pits may be spaced apart. In one embodiment, the pseudo-random pattern may approximate the appearance of conventional abrasive blasting. In one embodiment, the pseudo-random pattern may include overlapping pits. In one embodiment, surface 18 is texturized using a laser as provided herein and is also texturized through conventional abrasive blasting and/or chemical etching. For example, surface 18 may first be texturized by forcibly propelling a stream of abrasive material, such as beads, sand, and/or glass, against surface 18. After this step is completed, surface 18 may then be laser texturized as provided herein to create a controlled pattern across surface 18. Alternatively, surface 18 may be laser texturized before being subjected to abrasive blasting.

In some embodiments, a first portion of a metal surface may be treated differently than a second portion of the metal surface in order to create different patterns and visual effects. For example, in one embodiment, the first portion of a metal surface may be treated using the laser texturizing process described herein, and the second portion may not be subject to a texturizing step. In another embodiment, the first portion and second portions of surface 18 may be treated by different techniques. For example, the first portion may be subjected to abrasive blasting or chemical etching and the second portion may be subject to the laser texturizing process described herein. In addition, the two portions may be treated to have different degrees of scratch or abrasion resistance as desired.

Figure 12:
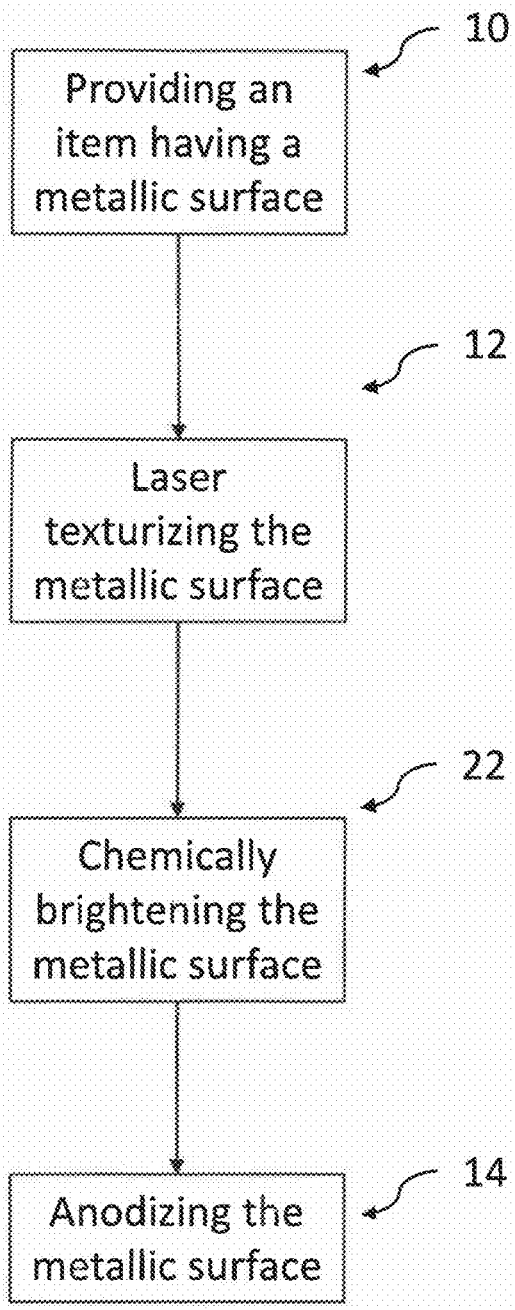
FIG. 12 is a flowchart of an exemplary method of surface treatment, in accordance with one embodiment of the present invention.

FIG. 12 is a high level flowchart of an exemplary method of surface treatment. The method includes the steps as described above of providing a metal part having a surface (step 10), performing a laser texturizing treatment on the surface of the metal part to create a controlled pattern across the surface (step 12), and performing an anodization process on the metallic surface (step 14). This method further includes the step 22 of chemically brightening the metallic surface.

In one embodiment, this chemical brightening step may be accomplished by exposing the surface to an acidic solution. Acids that may be used in the solution include, but are not limited to, phosphoric acid ($H_3PO_4$), nitric acid ($HNO_3$), sulfuric acid ($H_2SO_4$), and any suitable combinations thereof. The acid may be phosphoric acid, a combination of phosphoric acid and nitric acid, a combination of phosphoric acid and sulfuric acid, or a suitable combination of phosphoric acid, nitric acid and sulfuric acid. Other ingredients may include copper sulfate ($CuSO_4$) and water. In one embodiment, a solution of 85% phosphoric acid is utilized that is maintained at a temperature of 95 degrees Celsius. The processing time of chemical brightening step 22 may be adjusted depending upon a desired target gloss value. In one embodiment, the processing time may be in a range between about 40 and 60 seconds.

Figure 13:
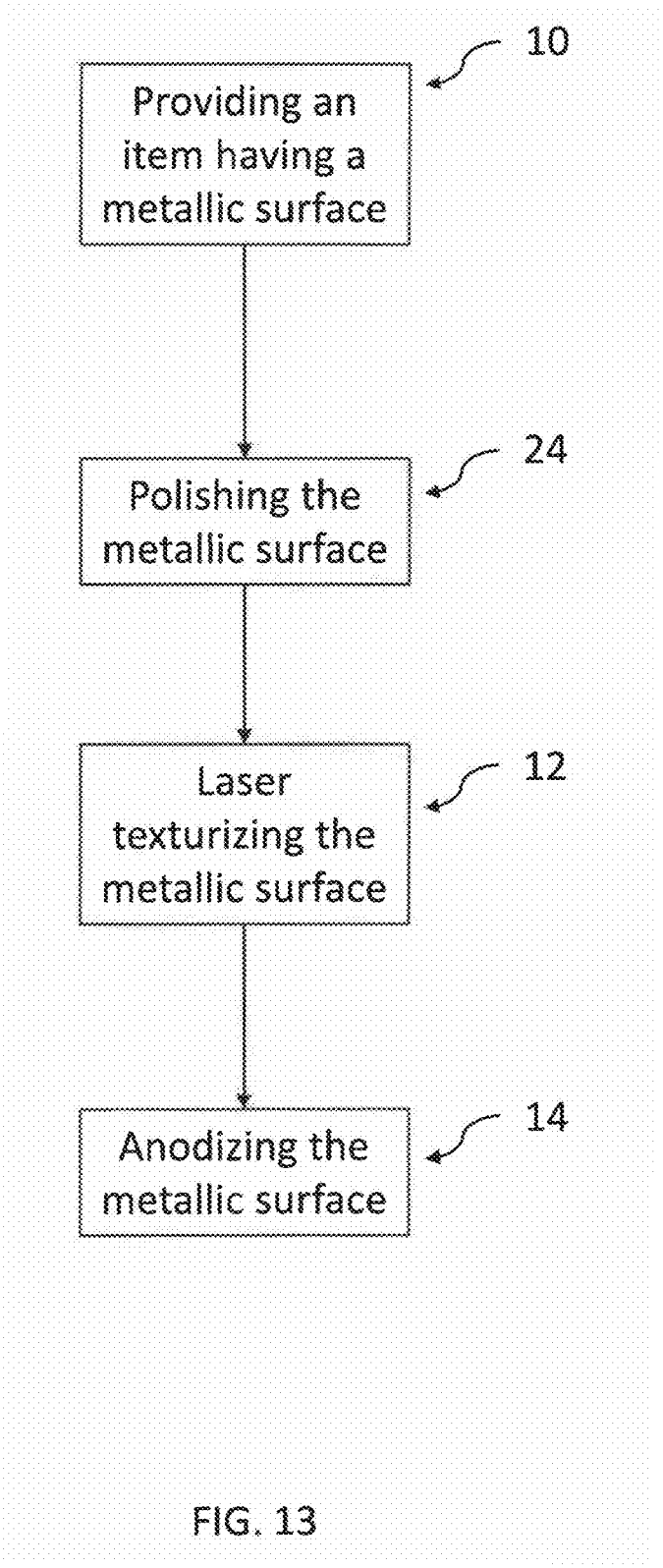
FIG. 13 is a flowchart of an exemplary method of surface treatment, in accordance with one embodiment of the present invention.

FIG. 13 is a high level flowchart of an exemplary method of surface treatment. The method includes the steps as described above of providing a metal part having a surface (step 10), performing a laser texturizing treatment on the surface of the metal part to create a controlled pattern across the surface (step 12), and performing an anodization process on the metallic surface (step 14). This method further includes the step 24 of polishing the metallic surface.

Polishing step 24 may be accomplished through any suitable polishing methods, such as buffing or tumbling. This step may be performed manually or with machine assistance. In one embodiment, the metal surface is polished via tumbling, which is involves placing the objecting in a tumbling barrel filled with a media and then rotating the barrel with the object inside it. Polishing step 24 may impart a smooth, glassy appearance to surface 18. For example, polishing step 24 may include tumbling the metal surface in a barrel for about 2 hours at a rotational speed of about 140 RPM. The barrel may be about 60% filled and the media may be crushed walnut shells mixed with a cutting media suspended in a lubricant, such as a cream.

Any of the above methods may include one or more further treatments on the metallic surface, such as rinsing, degreasing, de-smutting, dyeing, sealing, repeated polishing, texturizing, brightening, or anodization steps. For example, dyeing may generally refer to dipping or immersing a metal surface in a dye solution. Sealing may generally refer to immersing a metal surface in a sealing solution to close pores on a surface of the article. Polishing is generally described above, but it should be noted that similar or different polishing techniques may be used.

It is noted that the steps discussed above, illustrated in the flowcharts of FIGS. 1 and 8-9 are for illustrative purposes and are merely exemplary. Not every step need be performed and additional steps may be included as would be apparent to one of ordinary skill in the art to create a metallic surface having a desired effect. The steps may be reordered as desired. For example, step 24 of polishing the metallic surface may be performed before or after the texturizing step of step 24 as well as before or after the anodizing step of step 14.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

In addition, the breadth and scope of the present invention should not be limited by any of the above-described exemplary embodiments, but should be defined only in accordance with the following claims and their equivalents.

The invention claimed is:

1. A method of modifying a cosmetic quality of an aluminum alloy surface of an enclosure for an electronic device, the method comprising:

polishing the aluminum alloy surface, thereby forming a polished aluminum alloy surface on the enclosure;

forming a two-dimensional array of pits by passing a pulsed laser beam multiple times along a designated path over and impinging the polished aluminum alloy surface such that a remainder portion of the polished aluminum alloy surface is substantially unaffected by the pulsed laser beam, the depths of at least some of the pits increased with each pass, wherein the pits are substantially uniformly spaced apart and have diameters of between about 20 micrometers to about 25 micrometers;

forming a blasted texture on the two-dimensional array of pits and the remainder portion by propelling a stream of abrasive material at the aluminum alloy surface;

after forming the blasted texture, chemically brightening the blasted two-dimensional array of pits and the remainder portion by exposing the aluminum alloy surface to an acidic solution; and forming an oxide layer on the chemically brightened and blasted two-dimensional array of pits and the remainder portion using an anodizing process, wherein the oxide layer is sufficiently transparent such that the two-dimensional array of pits and the remainder portion are observable through the oxide layer.

2. The method of claim 1, wherein the pulsed laser beam is passed over the polished aluminum alloy surface at least four times.

3. The method of claim 1, wherein forming the two-dimensional array of pits modifies a grain structure of the polished aluminum alloy surface.

4. The method of claim 1, wherein a first portion of the pits have a first depth and a second portion of the pits have a second depth different than the first depth.

5. The method of claim 1, wherein the pits are arranged in columns that are offset with respect to each other.

6. The method of claim 1, wherein the pits are spaced about 50 micrometers apart.

7. A method of treating an aluminum alloy surface of an enclosure of an electronic device, the method comprising:

polishing the aluminum alloy surface forming a polished metal surface;

creating a decorative pattern on the polished metal surface by making multiple passes of a pulsed laser beam along a designated path over and impinging the polished metal surface, the pulsed laser beam forming a two-dimensional array of substantially uniformly spaced pits surrounded by a remainder portion that is substantially unaffected by the pulsed laser beam, wherein the pulsed laser beam increases depths of the pits with each pass, wherein the pits have diameters of between about 20 micrometers to about 25 micrometers;

forming a blasted texture on the two-dimensional array of pits and the remainder portion by propelling a stream of abrasive material at the aluminum alloy surface;

after forming the blasted texture, chemically brightening the blasted two-dimensional array of pits and the remainder portion by exposing the aluminum alloy surface to an acidic solution; and anodizing the aluminum alloy surface after propelling the stream of abrasive material, thereby forming an oxide layer on the chemically brightened and blasted two-dimensional array of pits and the remainder portion, wherein the oxide layer is sufficiently transparent such that the pits and the remainder portion are observable through the oxide layer, wherein the depths of the pits are associated with a visual appearance of the enclosure.

8. The method of claim 7, wherein a first portion of the pits have a first average depth and a second portion of the pits have a second average depth different than the first average depth.

9. The method of claim 7, wherein each of the pits is characterized as having a substantially circular shape.

10. The method of claim 7, wherein the pits are characterized as having substantially the same diameter.

11. The method of claim 7, wherein a first portion of the pits have a first diameter and a first depth, and a second portion of the pits having a second diameter different than the first diameter and a second depth different than the first depth.

12. The method of claim 7, wherein the pits modify a tactile quality of the polished metal surface.

13. The method of claim 7, wherein the pits are spaced a predetermined distance apart from each other, the predetermined distance chosen to reduce an appearance of surface defects, fingerprints or smudges on the enclosure of the electronic device.

14. The method of claim 7, wherein the pulsed laser beam is directed at a substantially perpendicular direction relative to the polished metal surface.

15. The method of claim 7, wherein the abrasive material includes at least one of beads, sand, or glass.

16. The method of claim 7, wherein the pulsed laser beam is passed over the polished aluminum surface at least four times.

17. The method of claim 7, wherein creating the decorative pattern on the polished metal surface modifies a grain structure of the polished metal surface.

18. The method of claim 7, wherein the pits are arranged in columns that are offset from one another.

19. The method of claim 7, wherein the pits are approximately 50 micrometers apart.

20. The method of claim 7, wherein creating the decorative pattern comprises the use of a computer numerical control machine along three or more axes.

* * * * *